US010292885B2

(12) United States Patent
Tong

(10) Patent No.: US 10,292,885 B2
(45) Date of Patent: May 21, 2019

(54) MULTIFUNCTIONAL CRITICAL CARE SYSTEM AND OPERATION METHOD THEREOF

(71) Applicants: Sichuan Xingzhi Zhihui Intellectual Property Operation Co., Ltd., Chengdu, Sichuan (CN); Chunping Tong, Sichuan (CN)

(72) Inventor: Chunping Tong, Sichuan (CN)

(73) Assignees: SICHUAN XINGZHI ZHIHUI INTELLECTUAL PROPERTY OPERATION CO., LTD., Chengdu (CN); Chunping Tong, Chengdu (CN)

( * ) Notice: Subject to any disclaimer, the term of this patent is extended or adjusted under 35 U.S.C. 154(b) by 18 days.

(21) Appl. No.: 15/551,076

(22) PCT Filed: Apr. 15, 2016

(86) PCT No.: PCT/CN2016/079433

§ 371 (c)(1),
(2) Date: Aug. 15, 2017

(87) PCT Pub. No.: WO2016/169440

PCT Pub. Date: Oct. 27, 2016

(65) Prior Publication Data

US 2018/0028382 A1 Feb. 1, 2018

(30) Foreign Application Priority Data

Apr. 21, 2015 (CN) ..... 2015 1 0189793

(51) Int. Cl.
*A61G 7/10* (2006.01)
*A61G 7/015* (2006.01)
(Continued)

(52) U.S. Cl.
CPC ..... *A61G 7/1044* (2013.01); *A61G 7/0005* (2013.01); *A61G 7/012* (2013.01);
(Continued)

(58) Field of Classification Search
CPC .... A61G 7/1044; A61G 7/0005; A61G 7/012; A61G 7/015; A61G 7/018; A61G 7/047;
(Continued)

(56) References Cited

U.S. PATENT DOCUMENTS 1,318,429 A * 10/1919 Young ..... A61G 7/1015 5/85.1
1,459,112 A * 6/1923 Mehl ..... A61G 7/1019 5/216

(Continued)

FOREIGN PATENT DOCUMENTS

CN 204542714 U 8/2015
DE 202005000010 U1 5/2005

*Primary Examiner* — Robert G Santos
*Assistant Examiner* — Rahib T Zaman
(74) *Attorney, Agent, or Firm* — Chieh-Mei Wang

(57) ABSTRACT

The present invention discloses a multifunctional critical care system and an operation method thereof. A lifting frame disposed on the bed body, a bed plate and a plurality of lifting bands are disposed at the lifting frame, and a tensioning mechanism is disposed on the lifting frame; The bed plate comprises vertical elevating mechanisms, a transverse telescopic mechanism disposed between the vertical elevating mechanisms; the lifting frame is connected to a tilting mechanism; fastening the lifting bands to lifting bands fastening devices, actuating the vertical elevating power mechanisms; actuating the transverse telescopic power mechanism; actuating the tensioning power mechanism; and actuating the transmission power mechanism. The nursing care mechanism facilitates replacement of bed sheets, ventilating the back, letting the patient laid on their left or right side, cleaning and wiping the body, defecation; and combines the functions of a nursing equipment, a sickbed, and a wheelchair.

9 Claims, 2 Drawing Sheets

(51) Int. Cl.

| | |
|---|---|
| ***A61G 7/00*** | (2006.01) |
| ***A61G 7/012*** | (2006.01) |
| ***A61G 7/018*** | (2006.01) |
| ***A61G 7/053*** | (2006.01) |
| ***A61G 7/047*** | (2006.01) |

(52) U.S. Cl.
CPC ..... *A61G 7/015* (2013.01); *A61G 7/018* (2013.01); *A61G 7/047* (2013.01); *A61G 7/053* (2013.01); *A61G 7/0536* (2013.01); *A61G 7/1015* (2013.01); *A61G 7/001* (2013.01); *A61G 7/10* (2013.01)

(58) Field of Classification Search
CPC .... A61G 7/053; A61G 7/0536; A61G 7/1015; A61G 7/001; A61G 2200/32; A61G 7/1013; A61G 7/1019; A61G 7/1025; A61G 7/1032; A61G 7/104; A61G 7/0146; A61G 7/10
USPC ..... 5/88.1, 612
See application file for complete search history.

(56) References Cited

U.S. PATENT DOCUMENTS 1,597,962 A * 8/1926 Foy ..... A61G 7/1015 5/88.1
3,383,717 A * 5/1968 Underwood ..... A61G 7/1015 5/607
4,800,599 A * 1/1989 Korchinski ..... A61G 7/002 5/507.1
4,843,665 A * 7/1989 Cockel ..... A61G 7/0005 5/88.1
4,939,801 A * 7/1990 Schaal ..... A61G 7/001 5/607
5,161,267 A * 11/1992 Smith ..... A61G 7/1015 5/612
5,315,723 A * 5/1994 Smith ..... A61G 7/1015 5/85.1
5,428,851 A * 7/1995 Shore ..... A61G 7/1019 5/424
6,295,666 B1 * 10/2001 Takaura ..... A61G 7/001 5/611
6,701,553 B1 * 3/2004 Hand ..... A61G 7/008 5/428
7,197,778 B2 * 4/2007 Sharps ..... A61G 7/1046 5/607
7,434,278 B2 * 10/2008 White ..... A61G 7/1015 5/81.1 HS
9,744,087 B2 * 8/2017 Jackson ..... A61G 7/015
2004/0221390 A1 * 11/2004 Frey ..... A47C 23/24 5/613
2006/0150320 A1 * 7/2006 Gramkow ..... A61G 7/1015 5/81.1 R
2011/0000016 A1 * 1/2011 Shriver ..... A61G 7/1019 5/86.1
2012/0159709 A1 * 6/2012 Nguyen ..... A47C 21/028 5/488
2017/0231846 A1 * 8/2017 Farrington ..... A61G 7/1021 5/83.1

* cited by examiner

MULTIFUNCTIONAL CRITICAL CARE SYSTEM AND OPERATION METHOD THEREOF

FIELD OF THE INVENTION

The present invention relates to the medical device field, and more particularly to a multifunctional critical care system and an operation method thereof.

BACKGROUND OF THE INVENTION

With the progress of the society and the development of the economy, childbearing concept in every country has changed, including family planning policy in China, resulting in worldwide transformation of the population structure and population aging around the world. The aged population might have some symptoms such as remaining in bed and poor function for walking. Nowadays, human might get many serious diseases (for example, terminal cancer) due to air pollution, diet hygiene, pesticide, chemical pollution and the like. Most of the patients suffering from these serious diseases would remain in bed and lose the ability to move, and critical patients suffer severe pains during movement. Alternatively, the patients injured in accidents resulted from, for example, traffic or industrial production, would also confront the situation of remaining in bed, losing the ability to move and suffering severe pains during movement. The aforementioned aged population and critical patients have the nursing needs of periodically replacing the bed sheets, ventilating the back, regularly wiping the body, defecation, dining, leaving bed for examination and treatment, moving outside to enjoy the sunshine and breathe fresh air. The patients suffering severe pains for excessive movements have to give up the aforementioned nursing needs or reduce the frequency of nursing care, leading the patients to feel painful, uncomfortable, or miserable which may not be good for rehabilitation. Most aged patients are empty-nesters, or their children are unable to take care of them for a long time because of the pressure to make a living. The nursing needs described above require much physical effort that is difficult to their aged husbands or wives. Thus they have no choice but give up all or part of the aforementioned nursing needs and feel miserable on the bed. At hospitals, gerocomiums, sanatoriums, or homes, even professionals for nursing care services could not provide satisfying nursing care with the conventional medical devices. At present, some better medical devices are only capable of solving issues of sitting, excretion and dining. The other nursing needs such as replacing bed sheets, ventilating patient's back, regularly wiping the body, leaving bed for examination and treatment, moving outside to enjoy the sunshine and breathe fresh air would be painful, or create high nursing intensity at the cost of poor nursing quality.

BRIEF SUMMARY OF THE INVENTION

The technical problem that the present invention aims to solve is that providing a multifunctional critical care system and an operation method thereof. The system and the operation method thereof are capable of lifting the patients in a comfortable way, and subsequently being easy to replace bed sheets, ventilate the patient's back, lie on the left or right side of the patient's body, clean and wipe the body, defecation; in addition, for the patients needing to leave bed for examination and treatment, a stretcher could be placed under the lifting bands to transfer patient painlessly, or the patient is able to be examined and treated directly on the present invention; moreover, for the patient requiring moving outside to enjoy sunshine and breathe fresh air, the present invention could be pushed out of the ward or bedroom directly. The present invention combines the functions of a nursing equipment, a sickbed and a wheelchair. Also, the present invention is a nursing equipment necessary for physical and mental health of critical patients and the aged population, and a multifunctional product desired by nurses and relatives of the patients, meeting the professional nursing needs of homes, hospitals, nursing institutions for the aged population.

The aims of the present invention are implemented by the following technical schemes: a multifunctional critical care system comprises a bed body, a lifting frame disposed on the bed body. A bed plate and a plurality of lifting bands are disposed at the lifting frame, wherein two ends of each of the lifting bands are fixed onto the lifting frame, and lifting bands are disposed above the bed plate. The lifting frame comprises a tensioning mechanism capable of adjusting a tension of the lifting bands, and the tensioning mechanism is connected to the lifting bands. Two vertical elevating mechanisms capable of elevating and descending along a vertical direction are respectively disposed on two sides of the bed plate; a bottom end of each of the vertical elevating mechanisms is fixed onto the bed body, while a top end of each of the vertical elevating mechanisms is fixed onto the lifting frame. A transverse telescopic mechanism capable of extending and reacting along a horizontal direction is disposed between the vertical elevating mechanisms, and the transverse telescopic mechanism is mounted on the bed body. In addition, the transverse telescopic mechanism is also connected to the vertical elevating mechanisms. The lifting frame is connected with a rotatable tilting mechanism, and the tilting mechanism is connected with the lifting frame. According to the present technical scheme, the patient could be lifted by taking advantage of present invention moving in the vertical direction, by means of which the patient would be air-permeable and the bed sheets could be replaced conveniently. Furthermore each of the vertical elevating mechanisms is designed to move separately, enabling the patient to turn over under the action of gravity, so that the medical staff could clean and wipe the patient's body or assist the patient with defecation. The transverse dimension of the present invention might be changed by the transverse telescopic mechanism, not only being suitable for patients with different sizes, but also being convenient for the present invention to pass through a narrow doorway. According to the tensioning mechanism, the patient could be more comfortable on the lifting bands by adjusting the tension of lifting bands. The tilting mechanism supports the patient's upper body, causing the patient to feel pleasant for resting or dining. Particularly, the tilting mechanism is necessary for outdoor activities. The existing nursing vehicles or sickbeds are single in structure and function. The person having ordinary skill in the art could not complete or figure out such scheme for being stuck with design idea and structure principle. However, the present invention unites the functions of a nursing equipment, a sickbed and a wheelchair. Also, the present invention is a nursing equipment necessary for physical and mental health of critical patients and the aged population, and a most desirable multifunctional product for nurses and relatives of the patients, meeting the professional nursing needs of homes, hospitals, nursing institutions for the aged population.

The present scheme focuses on people orientation, caring for the elderly and patients. Senility, being bedridden, serious diseases might be inevitable for everyone regardless of wealth. At that time, the most desirable things might be suffering less pain, leaving wards to enjoy the sunshine and breathing fresh air, rehabilitating or dying with comfort in mind. The present multifunctional critical care nursing equipment sickbed could easily achieve the aforementioned aims with various functions and humanized designs thereof, providing the users with better nursing, physical and mental pleasure, and allowing the nurses, especially the aged nurses, to easily take care of patients or their relatives without paying much effort.

The lifting frame comprises two supporting tubes parallel with each other, wherein the top end of each of the vertical elevating mechanisms contacts a bottom portion of each of the supporting tubes. The lifting bands are disposed between the supporting tubes, while each of the lifting bands is also connected to the supporting tubes. The tensioning mechanism is connected to the supporting tubes. An elevating track is disposed below the supporting tubes, and a bottom end of the elevating track is fixed vertically onto the bed body. An elevating guide rod is disposed at the elevating track, wherein a top end of the elevating guide rod is vertically fixed onto a bottom end of one of the supporting tubes, and the elevating guide rod is moveable along the elevating track in the vertical direction. A transverse telescopic track is disposed between the supporting tubes. One end of the transverse telescopic track is vertically fixed onto one of the supporting tubes. A transverse guide rod is disposed at the transverse telescopic track, and the transverse guide rod extends through the transverse telescopic track and is vertically fixed onto the other one of the supporting tubes. The transverse guide rod is moveable along the corresponding transverse telescopic track in the horizontal direction. Each of the vertical elevating mechanisms comprises an elevating frame and a connecting tube, wherein a top portion of the elevating frame is fixed onto the connecting tithe, and the connecting tube is disposed directly below the corresponding one of the supporting tubes. The connecting tube moves with the elevating frame in the vertical direction. Two ends of the transverse telescopic mechanism are both fixed with a bottom portion of the elevating frame. One end of a drive screw is provided with a transmission power mechanism, which the latter is disposed on an exterior of the connecting tube. The transverse telescopic mechanism is connected to a transverse telescopic power mechanism. Each of the vertical elevating mechanisms is connected to one of a plurality of vertical elevating power mechanisms. Both of the elevating track and the transverse telescopic track employ design for silencing of noise, allowing the processes of vertical elevating and descending, as well as the processes of transverse extending and reacting to be stable, and have no obvious shaking or noise. Moreover, the one-way moving track is unique, and the phenomenon of blocking could be avoided. For automatic products, the vertical elevating power mechanisms, the tensioning power mechanism or the transverse telescopic power mechanism could all employ either hydraulic power or electric power depending on the users' requirements. The configuration of hydraulic power comprises a hydraulic pump and valves for electrical and automatic control of elevating and descending; while the configuration of electric power comprises a motor, a speed regulator, a helix transmission mechanism, a charger, a storage battery and the like. For manual products, manpower could output power via screw transmission or transmission of hydraulic cylinder, so as to control the processes of vertical lifting and descending process, transverse extending and reacting, or tensioning. The lifting bands are able to be elevated or descended by means of the vertical elevating mechanisms. The left and right mechanisms could move entirely or separately enabling the patient to turn over easily. The automatic products could also allow the patient to lie on different sides within a set period.

The tilting mechanism comprises a drive screw, and two bearing blocks respectively nest one end of the drive screw. The bearing blocks and the drive screw are both disposed in the connecting tube. A drive nut nests an outer wall of the drive screw, while the drive nut is disposed between the bearing blocks, and is moveable along the outer wall of the drive screw. The screw nut is connected with a tilting support post, wherein one end of the tilting support post away from the screw nut is connected to one of the supporting tubes. Each of the supporting tubes comprises a first supporting tube and a second supporting tube. A universal joint is disposed between the first supporting tube and the second supporting tube. The universal joint is connected with both of the first supporting tube and the second supporting tube. The first supporting tube is capable of rotating around the universal joint, and the first supporting tube is close to the drive screw, while the second supporting tube is connected to a top portion of the connecting tube. The end of the tilting support post away from the screw nut is connected to the first supporting tube. The tensioning mechanism is connected to a tensioning power mechanism. After the power is switched by a clutch mechanism, the present invention raises section for patient's upper body of tensioning shaft of the fabric lifting bands by lever principle. In this way, the patient's upper body could recline or sit on the present invention. Then the number of lifting bands close to the legs is properly reduced, enabling the patient's legs to freely hang down, and utilizing the lifting bands to secure legs, so that the patient would not be flung out when the patient inclines forward.

A bedhead is disposed on the bed body, and a bottom end of the bedhead is fixed on a top end of the bed body. The first supporting tube is disposed between the bedhead and the second supporting tube. A handle is disposed on one end of the bedhead away from the first supporting tube. Two sets of joint wheels are disposed under the bed body, and the joint wheels are installed evenly on a bottom surface of the bed body. The joint wheels apply the existing structure including brake, which is convenient for the present invention to move and stop. As one part of a sickbed, the bedhead has a basic structure and function, and is further a control center, especially for smart products in the product series of the present invention. The handle is made of engineering plastic or metal, acting as an exerting point for movement.

An operation method of a multifunctional critical care system, comprising following steps: fastening lifting bands passing under a body of a patient to lifting bands fastening devices disposed on the supporting tubes, and actuating vertical elevating power mechanisms to lift up an elevating frame so as to lift the supporting tubes to a certain height until separation of the patient and a bed plate; actuating a transverse telescopic power mechanism to extend or react the transverse telescopic mechanism, and changing a distance between the supporting tubes; actuating a tensioning power mechanism to adjust a tension of the lifting bands, so that the patient is comfortably laid or sat; actuating a transmission power mechanism to move a drive nut along a drive screw, and rotating a first supporting tube around the universal joint under an action of a tilting support post, so as to support an upper body of the patient. Generally, the lifting bands are passed under the patient's body, for example the legs, the back, the neck and the head. The nurse could control the vertical elevating power mechanisms with manpower or other powers to raise the present invention. During lifting process, the elevating guide rod moves in the elevating track in the vertical direction, not only limiting the moving track, but also supporting the stress. When the patient is elevated to a proper height, the bed plate could be removed, leaving enough room for ventilating the patient's back, and also being convenient to replace the bed sheets. Moreover, the left and right vertical elevating power mechanisms are capable of lifting and descending entirely or separately, allowing the patient's body to turn over. The automatic products could also allow the patient to lie on different sides within a set period. The transverse telescopic power mechanism is used to change the transverse width between the supporting tubes, by means of which the present invention could be used by patients with different sizes, or pass the doorway, elevator door and other narrow area without colliding or blocking. Then the tension of the lifting bands is adjusted according to patient's weight and the width between the supporting tubes, achieving optimum comfort level. When dining or being outside, the patient's upper body should be leaned on the present invention. Such process needs to be implemented by the transmission power mechanism, which rotates the drive screw, resulting in the variation of location of the tilting support post, therefore supporting the patient's upper body. The principle of such method is simple and convenient, thus the nurses could operate the present invention without too much professional knowledge. Different operations could be carried out in virtue of the patient's situation, so as to properly take care of patient's mind and body.

Table plates, infusion support and other accessories: users could select the particular accessories according to their physical condition, personal preference, geography environment of house, economic condition, and so forth, allowing nursing vehicles/sickbed for critical diseases to have personalization options, and to be suitable for many places such as hospitals, gerocomiums, sanatoriums, homes, etc.

In sum, the present invention has the following beneficial effects:

1. After the nursing mechanism comfortably lifts a proper person, the nursing needs such as replacing bed sheets, ventilating the back, lying on left or right side, cleaning and wiping body, defecation, leaving sickbed to have inspection and treatment could be easily implemented; a stretcher could be placed under the lifting bands enabling to transfer patients painlessly;
2. The patient is able tee be examined and treated directly on the present invention; for patients requiring moving outside to enjoy sunshine and breathe fresh air, the present invention could be pushed out of the ward or bedroom directly; the present invention combines the functions of a nursing equipment, a sickbed and a wheelchair; also, the present invention is a nursing equipment necessary for physical and mental health of critical patients and the aged population, and a multifunctional product desired by nurses and relatives of the patients, meeting the professional nursing needs of homes, hospitals, nursing institutions for the aged population.

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
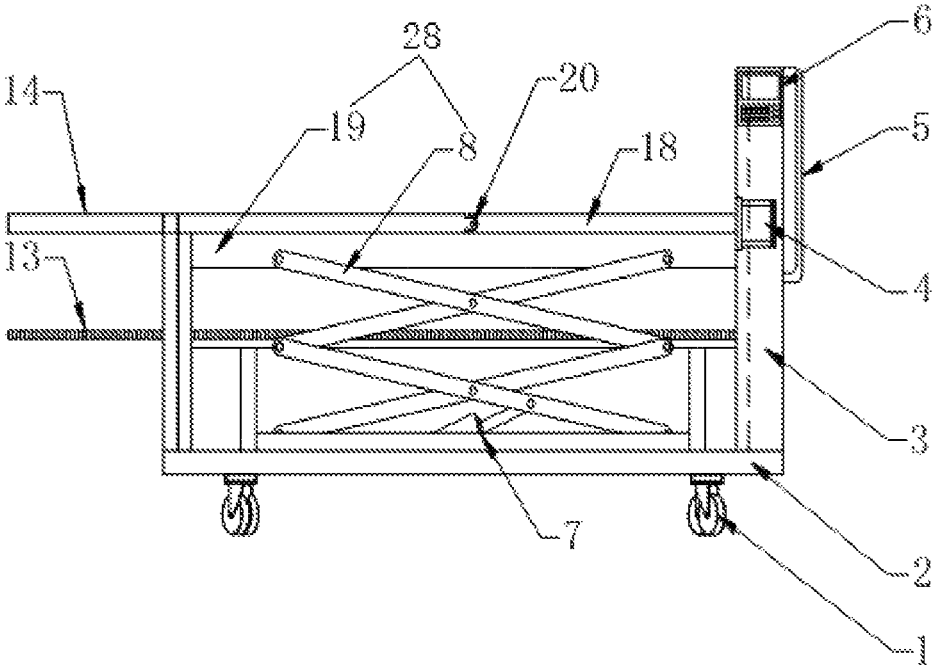
FIG. 1 is a front view of an embodiment of the present invention.
Figure 2:
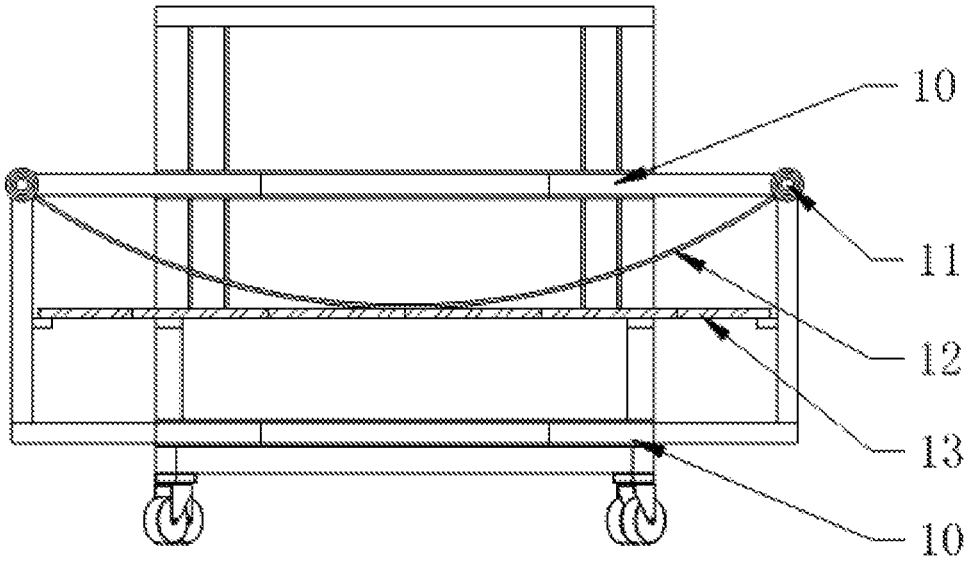
FIG. 2 is a side view of an embodiment of the present invention.
Figure 3:
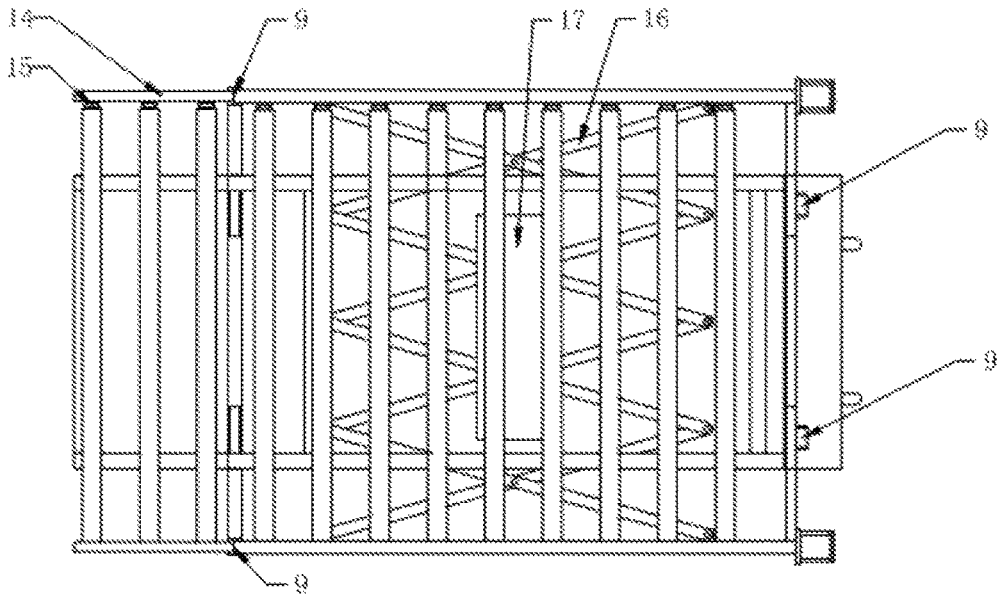
FIG. 3 is a top view of an embodiment of the present invention.
Figure 4:
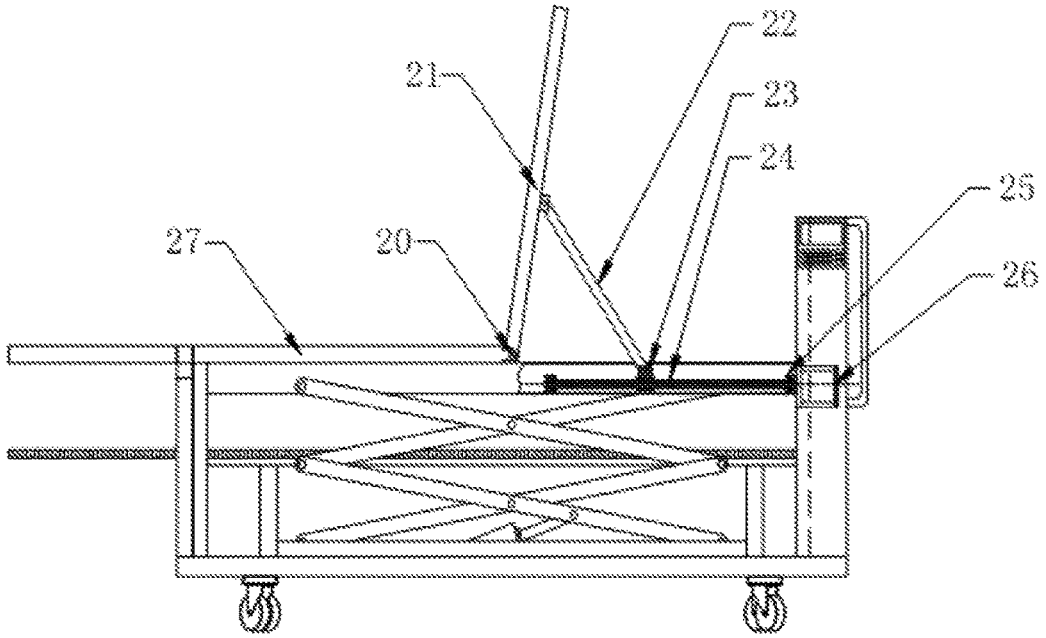
FIG. 4 is a schematic diagram of an embodiment of the present invention for leaning or sitting.

Embodiment 1:

As shown in FIG. 1, FIG. 2, FIG. 3, FIG. 4, a multifunctional critical care system, comprising a bed body, a lifting frame disposed on the bed body 2. A bed plate 13 and a plurality of lifting bands 12 are disposed at the lifting frame; two ends of each of the lifting bands 12 are fixed onto the lifting frame. The lifting bands 12 are disposed above the bed plate 13. The lifting frame comprises a tensioning mechanism 11 capable of adjusting a tension of lifting bands, and the tensioning mechanism 11 is connected to the lifting bands. Two vertical elevating mechanisms capable of lifting and descending along a vertical direction are respectively disposed on two sides of the bed plate 13. A bottom end of each of the vertical elevating mechanises is fixed into the bed body 2, while a top end of each of the vertical elevating mechanisms is fixed onto the lifting frame. A transverse telescopic mechanism 16 capable of extending and reacting along a horizontal direction is disposed between the vertical elevating mechanisms. The transverse telescopic mechanism 16 is mounted on the bed body 2, and the transverse telescopic mechanism 16 is also connected to the vertical elevating mechanisms. The lifting frame is connected with a rotatable tilting mechanism, and the tilting mechanism is connected with the lifting frame. For automatic product, a control box 6 could be disposed on the bedhead. After the nurse properly fastens the lift bands and protecting bands for head and neck, the start button would be pressed to cause the nursing vehicle/sickbed for critical diseases to complete all preset motions automatically. In the first use, the parameters letting patient feel comfortable could be set. Also, the various mechanisms could be controlled by electric power. The bed body 2 is made of cast aluminum, cast iron, welded steel tube, and welded and spliced aluminum profile. The other comfortable accessories are made of hygienic standard engineering plastics, foam materials and so on. The comfortable fabric lifting bands 12 with high strength are employed to provide close fitting, comfort, ventilation, safety. The operation is convenient for nurse and the lifting bands for head and neck applied ergonomics design. The lifting bands fastening devices 15 disposed on the supporting tubes 18 causes the nursing work to be easier and timesaving. The fabric lifting bands connects to supporting tubes 18 through lifting bands fastening devices having quick locking and releasing function. In addition, the tension of the lifting bands could be adjustable by controlling the tensioning power mechanism 4. When being used as a cart or a wheelchair, the bed plate should be folded; when being used as a sickbed, unfolding the bed plate. The bed plate is provided with a hole for excrement, allowing the patients to excrete with functions of wheelchair or sickbed, and to urinate with function of wheelchair.

The critical care system unites the functions of a nursing equipment, a sickbed, and a wheelchair. Therefore additional sickbed or wheelchair could not be provided, saving the cost and reducing the space for additional equipment. Also, the patient needs not to be transferred by hands, reducing the labor intensity while improving safety.

The present scheme is a device for the patients with limited mobility. The patients is lifted in a comfortable way, allowing to replace the bed sheets, ventilate the patient's back, lie on the patient's left or right side, clean and wipe the body, defecation; in addition, for the patients needing to leave bed to be examined and treated, a stretcher could be placed under the lifting bands to transfer patient painlessly; Patient is able to have examination and treatment directly on the present invention; for the patient requiring moving outside to enjoy sunshine and breathe fresh air, the present mechanism could be pushed out of the ward or bedroom directly. The present mechanism combines the functions of a nursing equipment, a sickbed and a wheelchair. Also, the present invention is a nursing equipment necessary for physical and mental health of critical patients and the aged population, and a multifunctional product desired by nurses and relatives of the patients, meeting the professional nursing needs of homes, hospitals, nursing institutions for the aged population.

Embodiment 2:

Based on Embodiment 1, the lifting frame comprises two supporting tubes 18 parallel with each other, wherein the top end of each of the vertical elevating mechanisms contacts a bottom portion of each of the supporting tubes 18. The lifting bands 12 are disposed between the supporting tubes 18, while each of the lifting bands 12 is also connected to the supporting tubes 18. The tensioning mechanism 11 is connected to the supporting tubes 18. An elevating track 9 is disposed below the supporting tubes 18, and a bottom end of the elevating track 9 is fixed vertically onto the bed body 2. An elevating guide rod is disposed at the elevating track 9, wherein a top end of the elevating guide rod is vertically fixed onto a bottom end of one of the supporting tubes 18, and the elevating guide rod is moveable along the elevating track 9 in the vertical direction. A transverse telescopic track 10 is disposed between the supporting tubes 18. One end of the transverse telescopic track 10 is vertically fixed onto one of the supporting tubes 18. A transverse guide rod is disposed at the transverse telescopic track 10, and the transverse guide rod extends through the transverse telescopic track 10 and is vertically fixed onto the other one of the supporting tubes 18. The transverse guide rod is moveable along the corresponding transverse telescopic track 10 in the horizontal direction. Each of the vertical elevating mechanisms comprises an elevating frame 8 and a connecting tube 19, wherein a top portion of the elevating frame 8 is fixed onto the connecting tube 19; and the connecting tube 19 is disposed directly below the corresponding one of the supporting tubes 18. The connecting tube 19 moves with the elevating frame 8 in the vertical direction. Two ends of the transverse telescopic mechanism 16 are both fixed with a bottom portion of the elevating frame 8. The transverse telescopic mechanism is connected to a transverse telescopic power mechanism 17; each of the vertical elevating mechanisms is connected to one of a plurality of vertical elevating power mechanisms 7; the tensioning, mechanism 11 is connected to a tensioning power mechanism 4. In order to improve comfort of the patient, after the patient is elevated to a certain height, the lifting bands could be properly tight or loose by controlling the lifting bands fastening device according to the patient's feeling. The tightest state might be horizontal. The tensioning telescopic mechanism 14 is also a rotating shaft of tensioning mechanism. For shorten the length of movement, the structure thereof is designed as a two-section spline able to drive movement when extending or reacting. The connection point in the middle is also the universal joint 20 of the tilting mechanism. The vertical elevating track employs design for silencing of noise, allowing the processes of vertical elevating and descending to have no obvious shaking or noise. The lifting bands are capable of being lifted or descended by means of the vertical elevating mechanisms. The left and right mechanisms could move entirely or separately, enabling the patient to turn over easily. The automatic products could also allow the patient to lie on different sides within a set period, being convenient to wipe the patient's body. The transverse telescopic track employs design for silencing of noise, allowing the process of transverse extending and reacting to be stable and have no obvious shaking or noise. With the movement of the mechanism, the width of the product could be changed, by means of which is suitable for patients with different sizes, and is convenient to pass the doorway or elevator, allowing the nurse to bring the patient out of the ward.

Embodiment 3

Based on the aforementioned Embodiments, the tilting mechanism comprises a drive screw 24, and two bearing blocks 25 respectively nests one end of the drive screw 24. The bearing blocks 25 and the drive screw 24 are both disposed in the connecting tube 19. A drive nut 23 nests an outer wall of the drive screw 24, while the drive nut 23 is disposed between the bearing blocks 25, and is moveable along the outer wall of the drive screw 24. The screw nut 23 is connected with a tilting support post 22, wherein one end of the tilting support post 22 away from the screw nut is 23 connected to one of the supporting tubes 18. Each of the supporting tubes comprises a first supporting tube 21 and a second supporting tube 27. A universal joint 20 is disposed between the first supporting tube 21 and the second supporting tube 27. The universal joint 20 is connected with both of the first supporting tube 21 and the second supporting tube 27. The first supporting tube 21 is capable of rotating around the universal joint 20, and the first supporting tube 21 is close to the drive screw 24, while the second supporting tube 27 is connected to a top portion of the connecting tube 19. The end of the tilting support post 22 away from the screw nut 23 is connected to the first supporting tube 21. The drive screw 24 disposes a transmission power mechanism 26; the transmission power mechanism 26 is disposed on an exterior of the connecting tube 19. The drive screw 24 moves on the drive nut 23, driving the variation of the angle between the tilting support post 22 and the horizontal plan, so that the first supporting tube 21 rotates around the universal joint 20. At last, the patient's upper body is supported for more convenient relaxation and dining.

The tensioning power mechanism 4 of the fabric lifting bands could be operated by hands or power. For either the manual products or automatic products, the mechanisms on the two sides could be controlled entirely or separately, and move through a clutch mechanism. Such power could be used as the power for the tilting mechanism. The power of the transverse telescopic power mechanism 17, the vertical elevating power mechanisms 7, or the tensioning power mechanism 4 could all be automatic power or manual power. For automatic products, the users could select hydraulic power or electric power. The configuration of hydraulic power comprised a hydraulic pump and valves for electrical and automatic control of elevating and descending. While the configuration of electric power comprised a motor, a speed regulator, a helix transmission mechanism, a charger, a storage battery and the like. For manual products, manpower could output power via screw transmission or transmission of hydraulic cylinder, so as to control the processes of vertical elevating and descending process, transverse extending and reacting, or tensioning.

Embodiment 4:

On the basis of the Embodiments described above, a bedhead 3 is disposed on the bed body 2, and a bottom end of the bedhead 3 is fixed on a top end of the bed body 2. The first supporting tube 21 is disposed between the bedhead 3 and the second supporting tube 27. A handle 5 is disposed on one end of the bedhead 3 away from the first supporting tube 21. Two sets of joint wheels 1 are disposed under the bed body 2, and the joint wheels 1 are installed evenly on a bottom surface of the bed body 2. The joint wheels 1 generally consists of a front group and a back group to stably push the present invention. As one part of a sickbed, the bedhead 3 has a basic structure and function, and is further a control center, especially for smart products in the product series of the present invention. For automatic product, a control box 6 could be disposed on the bedhead 3, automatically completing all preset motions stored in the system. In the first use, the parameters letting patient feel comfortable could be set. Also, each mechanism could be controlled by electric power. The present invention relates to medical device field, suitable for the critical remaining in beds, losing ability to move, suffering pains during movement, and the aged population remaining beds. When the needs such as replacing bed sheets, ventilating the patient's back, wiping the body, defecation, dining, leaving sickbed to be examined and treated, leaving the ward to enjoy sunshine and breathe fresh air are required, the present invention could provide painless transfer of sickbed and move to the destination.

Embodiment 5:

As shown in FIG. 1, FIG. 2, FIG. 3, FIG. 4, an operation method of a multifunctional critical care system, comprising following steps: fastening lifting bands passing under a body of a patient to lifting bands fastening devices disposed on the supporting tubes, and actuating vertical elevating power mechanisms to lift up an elevating frame so as to lift the supporting tubes to a certain height until separation of the patient and a bed plate; actuating a transverse telescopic power mechanism to extend or react the transverse telescopic mechanism, and changing a distance between the supporting tubes; actuating a tensioning power mechanism to adjust a tension of the lifting bands, so that the patient is comfortably laid or sat; and actuating a transmission power mechanism to move a drive nut along a drive screw, and rotating the first supporting tube around the universal joint under an action of a tilting support post, so as to support an upper body of the patient. The lifting process mainly comprises vertical motion, transverse motion, adjustment of tension, supporting the upper body. The sequence of the aforementioned process is adjustable according to specific requirement. Generally the vertical motion is the most important as lifting the patient upwardly could leave sufficient space, allowing the patients to lose contact with the bed plate. Therefore the functions such as ventilation and replacing the bed sheets could be acted. Thus, the transverse motion or supporting process have sufficient place, causing no interference with other parts. The using principle is simple for nurse, so that the relatives could conveniently take care of the patient in house. The lower labor intensity enables the old couples to look after each other, which is especially advantageous for empty-nesters when they gets sick without accompanying of their children.

The time of the lifting process should not be too long. Preferably the lifting process has a regular period. Thus the functions such as ventilation or replacing bed sheets could be implemented, while the phenomenon of hyperemia occurred on the stressed body parts or local necrosis might be avoid.

As described above, the present invention could be better implemented.

What is claimed is:

1. A multifunctional critical care system, comprising a bed body, wherein a lifting frame is disposed on the bed body , a bed plate and a plurality of lifting bands are disposed at the lifting frame, two ends of each of the lifting bands are fixed onto the lifting frame, the lifting bands are disposed above the bed plate, the lifting frame comprises a tensioning mechanism capable of adjusting a tension of the lifting bands, and the tensioning mechanism is connected to the lifting bands; two vertical elevating mechanisms capable of elevating and descending along a vertical direction are respectively disposed on two sides of the bed plate, a bottom end of each of the vertical elevating mechanisms is fixed onto the bed body, a top end of each of the vertical elevating mechanisms is fixed onto the lifting frame, a transverse telescopic mechanism capable of extending and retracting along a horizontal direction is disposed between the vertical elevating mechanisms, the transverse telescopic mechanism is mounted on the bed body, and the transverse telescopic mechanism is also connected to the vertical elevating mechanisms; and the lifting frame is connected with a rotatable tilting mechanism, and the tilting mechanism is connected with the lifting frame;

wherein the tilting mechanism comprises a drive screw, two ends of the drive screw are respectively placed in two bearing blocks, the bearing blocks and the drive screw are disposed in the connecting tube, a drive nut nests an outer wall of the drive screw, the drive nut is disposed between the bearing blocks, and the drive nut is moveable along the outer wall of the drive screw, the screw nut is connected with a tilting support post, one end of the tilting support post away from the screw nut is connected to one of the supporting tubes; each of the supporting tubes comprise a first supporting tube and a second supporting tube, a universal joint is disposed between the first supporting tube and the second supporting tube, the universal joint is connected with both of the first supporting tube and the second supporting tube, and the first supporting tube is capable of rotating around the universal joint, the first supporting tube is close to the drive screw, the second supporting tube is connected to a top portion of the connecting tube, and the end of the tilting support post away from the screw nut is connected to the first supporting tube.

2. The multifunctional critical care system as claimed in claim 1, wherein the lifting frame comprises two supporting tubes parallel with each other, the top end of each of the vertical elevating mechanisms contacts a bottom portion of each of the supporting tubes, the lifting bands are disposed between the supporting tubes, and each of the lifting bands is also connected to the supporting tubes, the tensioning mechanism is connected to the supporting tubes.

3. The multifunctional critical care system as claimed in claim 2, wherein an elevating track is disposed below the supporting tubes, a bottom end of the elevating track is fixed vertically onto the bed body, an elevating guide rod is disposed in the elevating track, a top end of the elevating guide rod is vertically fixed onto a bottom end of one of the supporting tubes, and the elevating guide rod is moveable along the elevating track in the vertical direction.

4. The multifunctional critical care system as claimed in claim 2, wherein a transverse telescopic track is disposed between the supporting tubes, one end of the transverse telescopic track is vertically fixed onto one of the supporting tubes, a transverse guide rod is disposed at the transverse telescopic track, the transverse guide rod extends through the transverse telescopic track and is vertically fixed onto another one of the supporting tubes, and the transverse guide rod is moveable along the corresponding transverse telescopic track in the horizontal direction.

5. The multifunctional critical care system as claimed in claim 2, wherein each of the vertical elevating mechanisms comprises an elevating frame and a connecting tube, a top portion of the elevating frame is fixed onto the connecting tube, the connecting tube is disposed directly below the corresponding one of the supporting tubes, the connecting tube moves with the elevating frame in the vertical direction; and two ends of the transverse telescopic mechanism are both fixed with a bottom portion of the elevating frame.

6. The multifunctional critical care system as claimed in claim 1, wherein one end of the drive screw is provided with a transmission power mechanism, the transmission power mechanism is disposed on an exterior of the connecting tube; the transverse telescopic mechanism is connected to a transverse telescopic power mechanism, each of the vertical elevating mechanisms is connected to one of a plurality of vertical elevating power mechanisms, and the tensioning mechanism is connected to a tensioning power mechanism.

7. The multifunctional critical care system as claimed in claim 1, wherein a bedhead is disposed on the bed body, a bottom end of the bedhead is fixed on a top end of the bed body, the first supporting tube is disposed between the bedhead and the second supporting tube, a handle is disposed on one end of the bedhead away from the first supporting tube; and two sets of joint wheels are disposed under the bed body, and the joint wheels are installed evenly on a bottom surface of the bed body.

8. An operation method of a multifunctional critical care system as claimed in claim 1, wherein the operation method comprises steps of:

(a) fastening lifting bands passing under a body of a patient to lifting bands fastening devices disposed on supporting tubes, and actuating vertical elevating power mechanisms to lift up an elevating frame so as to lift the supporting tubes to a certain height until separation of the patient and a bed plate;

(b) actuating a transverse telescopic power mechanism to extend or retract a transverse telescopic mechanism, and changing a distance between the supporting tubes;

(c) actuating a tensioning power mechanism to adjust a tension of the lifting bands so that the patient is comfortably laid or sat; and (d) actuating a transmission power mechanism to move a drive nut along a drive screw, and rotating a first supporting tube around a universal joint under an action of a tilting support post, so as to support an upper body of the patient.

9. The operation method of the multifunctional critical care system as claimed in claim 8, wherein the vertical elevating power mechanisms used in the Step (a) is capable of elevating and descending entirely or separately, so as to allow the patient to lie on one side of the body.

* * * * *